US010060658B2

(12) United States Patent
Hofmann et al.

(10) Patent No.: US 10,060,658 B2
(45) Date of Patent: Aug. 28, 2018

(54) CONDENSER

(71) Applicant: MAHLE INTERNATIONAL GMBH, Stuttgart (DE)

(72) Inventors: Herbert Hofmann, Stuttgart (DE); Martin Kaspar, Fellbach (DE); Thomas Mager, Ludwigsburg (DE)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 281 days.

(21) Appl. No.: 14/429,911

(22) PCT Filed: Sep. 2, 2013

(86) PCT No.: PCT/EP2013/068092
§ 371 (c)(1),
(2) Date: Mar. 20, 2015

(87) PCT Pub. No.: WO2014/044520
PCT Pub. Date: Mar. 27, 2014

(65) Prior Publication Data

US 2016/0161160 A1 Jun. 9, 2016

(30) Foreign Application Priority Data

Sep. 21, 2012 (DE) ..... 10 2012 217 090

(51) Int. Cl.
*F25B 39/00* (2006.01)
*F25B 39/04* (2006.01)
(Continued)

(52) U.S. Cl.
CPC ..... *F25B 39/00* (2013.01); *F25B 39/04* (2013.01); *F28D 9/0056* (2013.01);
(Continued)

(58) Field of Classification Search
CPC ..... F25B 39/00; F25B 2339/044; F25B 2339/043; F28F 9/0253; F28F 9/26; F28D 9/0056; F28D 9/0075; F28D 2021/0084
See application file for complete search history.

(56) References Cited

U.S. PATENT DOCUMENTS 6,935,417 B1 * 8/2005 Inoue ..... F25B 15/02 165/167
7,469,554 B2 * 12/2008 Martins ..... F25B 39/04 165/140
(Continued)

FOREIGN PATENT DOCUMENTS

CN 102639953 A 8/2012
DE 10 2010 026 507 A1 1/2012
(Continued)

OTHER PUBLICATIONS

International Search Report, PCT/EP2013/068092, dated Nov. 27, 2013, 2 pgs.
(Continued)

*Primary Examiner* — Emmanuel Duke
(74) *Attorney, Agent, or Firm* — Paul D. Strain, Esq.; Strain & Strain PLLC

(57) ABSTRACT

The invention relates to a condenser of stacked plate design, having a first flow channel for a refrigerant and a second flow channel for a coolant, wherein a plurality of plate elements is provided, which form channels adjacent to each other between the plate elements when the plate elements are stacked on top of each other.

18 Claims, 4 Drawing Sheets

(51) Int. Cl.

| | |
|---|---|
| ***F28F 9/26*** | (2006.01) |
| ***F28D 9/00*** | (2006.01) |
| ***F28F 9/02*** | (2006.01) |
| *F28D 21/00* | (2006.01) |

(52) U.S. Cl.
CPC ..... *F28D 9/0075* (2013.01); *F28F 9/0253* (2013.01); *F28F 9/26* (2013.01); *F25B 2339/043* (2013.01); *F25B 2339/044* (2013.01); *F28D 2021/0084* (2013.01)

(56) References Cited

U.S. PATENT DOCUMENTS

| | | | | |
|---|---|---|---|---|
| 2009/0071189 | A1 | 3/2009 | Martins et al. | |
| 2012/0137725 | A1 | 6/2012 | Kim et al. | |
| 2012/0210746 | A1* | 8/2012 | Kadle | F25B 1/00 62/498 |
| 2012/0222846 | A1* | 9/2012 | Kadle | F28D 9/005 165/166 |
| 2012/0234523 | A1* | 9/2012 | Jouanny | F28D 9/005 165/166 |
| 2013/0146265 | A1* | 6/2013 | Kim | F25B 39/04 165/166 |

FOREIGN PATENT DOCUMENTS

| | | | | |
|---|---|---|---|---|
| DE | 10 2011 110 963 | A1 | 6/2012 | |
| DE | 10 2011 008 429 | A1 | 7/2012 | |
| DE | 10 2011 005 177 | A1 | 9/2012 | |
| FR | 2924490 | A1 * | 6/2009 | B60H 1/00342 |
| FR | 2 947 041 | A1 | 12/2010 | |
| WO | WO 2009/068547 | A1 | 6/2009 | |
| WO | WO 2011/039186 | A1 | 4/2011 | |

OTHER PUBLICATIONS

German Search Report, Appl. No. 10 2012 217 090.1, dated May 22, 2013, 5 pgs.

* cited by examiner

CONDENSER

CROSS-REFERENCE TO RELATED PATENT APPLICATIONS

This application is a National Stage of International Application No. PCT/EP2013/068092, filed Sep. 2, 2013, which is based upon and claims the benefit of priority from prior German Patent Application No. 10 2012 217 090.1, filed Sep. 21, 2012, the entire contents of all of which are incorporated herein by reference in their entirety.

DESCRIPTION

Technical Field

The invention relates to a condenser of stacked plate design, having a first flow channel for a refrigerant and a second flow channel for a coolant, wherein a plurality of plate elements is provided, which form channels adjacent to each other between the plate elements when the plate elements are stacked on top of each other, in particular in accordance with the preamble of claim 1.

Prior Art

Condensers are used in refrigerant circuits of air conditioning systems for motor vehicles in order to cool the refrigerant to the condensation temperature and then to condense the refrigerant. Condensers often have a receiver in which a refrigerant volume is held in order to compensate for volume fluctuations in the refrigerant circuit and to ensure stable subcooling of the refrigerant.

Additional means for drying and/or filtering the refrigerant are often provided in the receiver. Normally, the receiver is arranged on the condenser. The refrigerant which has already flowed through part of the condenser flows through the receiver. After flowing through the receiver, the refrigerant is returned to the condenser and is subcooled to below the condensation temperature in a subcooling section.

In the case of conventional condensers of fin and tube construction, the refrigerant is, for this purpose, passed out of the condenser out of one of the collecting tubes arranged at the side of a tube-fin block and passed into the receiver.

In the case of condensers which are of stacked plate design, there are known possibilities in the prior art for adding the receiver to the condenser as an additional layer of plate elements.

Another known practice is to pass the refrigerant out of the condenser of stacked plate design and feed it to an external receiver via a special distributor plate and, after the receiver, to return the refrigerant to the condenser. This is disclosed in the unpublished application of the applicant, DE 10 2010 026 507, for example.

US 2009/0071189 A1 furthermore discloses a condenser of stacked plate design in which a first stack of plate elements forms a first cooling and condensation region and a second stack or plate elements forms a subcooling region. The first stack is separated from the second stack by a housing which contains a receiver and a dryer.

The disadvantage with the prior art devices is that integrating condensers of stacked plate design, receivers and subcoolers previously involved a very complicated solution. Apart from a complex construction, the prior art condensers are distinguished by an increased outlay on manufacture. This results in additional costs in respect of the use of condensers, which make its use unattractive.

DESCRIPTION OF THE INVENTION, OBJECT, SOLUTION, ADVANTAGES

It is therefore the object of the present invention to provide a condenser which is suitable for condensing a refrigerant, storing it and furthermore for subcooling it, wherein the condenser is characterized by a simple construction and a compact design and can be produced at low cost.

The object of the present invention is achieved by a condenser of stacked plate design having the features of claim 1.

An illustrative embodiment of the invention relates to a condenser of stacked plate design, having a first flow channel for a refrigerant and having a second flow channel for a coolant, wherein a plurality of plate elements is provided, which form channels adjacent to each other between the plate elements when the plate elements are stacked on top of each other, wherein a first subset of the channels is associated with the first flow channel and a second subset of the channels is associated with the second flow channel, wherein the first flow channel has a first region for desuperheating and condensing the vaporous refrigerant and a second region for subcooling the condensed refrigerant, having a receiver for storing a refrigerant, wherein a refrigerant transfer from the first region to the second region leads through the receiver, wherein the receiver is in fluid communication with the first region by means of a first connection element, which forms the fluid inlet of the receiver, wherein a second connection element is in fluid communication with the second region as a fluid outlet of the receiver.

The construction of a condenser of stacked plate design can be implemented in a particularly simple and low-cost manner. In general, a multiplicity of identical plate elements can be used for construction. Only the outer boundary plates of the plate stack or plate elements within the plate stack which perform additional functions, such as blocking or diverting a flow channel, have a different configuration.

The division of the flow channel carrying the refrigerant into a first region, which is used for desuperheating and condensing the refrigerant in the vapor phase thereof, and a second region, which is used for subcooling the condensed refrigerant, has the effect that it is always fully subcooled refrigerant which is present at the end of the condenser.

In order to keep the refrigerant volume in the refrigerant circuit constant and to additionally dry and/or filter the refrigerant, it is additionally advantageous to integrate a receiver into the refrigerant circuit. It is advantageous if this is integrated into the refrigerant flow channel at a point following the complete condensation of the refrigerant and before the collection, drying and/or filtering of the refrigerant.

It is particularly advantageous if the first connection element is designed as a channel, and the channel leads from the first region, through the second region, to the fluid inlet of the receiver, wherein the channel is in fluid communication only with the first region of the first flow channel.

It is also advantageous if the second connection element is designed as a channel, and the channel leads from the fluid outlet of the receiver, through the first region, into the second region.

It is expedient here if the channel is a tube.

A preferred illustrative embodiment is characterized in that the first connection element or the second connection element is a tube which passes through a number of plate elements by means of openings in plate elements.

Using a tube to connect a receiver to the first flow channel, the condenser can be formed by a plate stack which consists predominantly of identical plate elements, despite arrangement of the receiver outside the condenser.

In this case, the tube is passed through a series of plate elements situated adjacent to one another. Here, the tube is preferably passed through the openings in the plate elements. In this case, the tube is inserted into the plate stack until it opens into one of the channels which is associated with the desired flow channel. In the present case, this is a channel of the first flow channel.

It is also preferable if the first connection element is designed as a tube and the tube leads from the first region, through the second region, to the fluid inlet of the receiver, wherein the tube is in fluid communication only with the first region of the first flow channel.

In order to integrate the receiver at the most favorable point for the overall working process of the condenser, it is particularly advantageous if the receiver is connected directly to the desuperheating and condensing region. This first region of the condenser is ahead of the second region, in which the subcooling takes place, when viewed in the flow direction of the refrigerant.

In order to pass all the refrigerant into the receiver from this first region of the first flow channel, the tube is dimensioned in such a way that it passes through all the plate elements of the second region and opens into a channel of the first region. In this way, the refrigerant is carried directly into the receiver, bypassing the second region.

In another preferred illustrative embodiment, provision can be made for the refrigerant to be able to flow through the channels forming the first flow channel in series and/or in parallel.

Advantages, particularly in respect of the heat transfer to be achieved, can be achieved through serial and/or parallel throughflow. Regions in which the refrigerant flows through the first flow channel in co-current or counter current flow with respect to the coolant can be produced.

Moreover, it may be advantageous if the coolant can flow through the channels forming the second flow channel in series and/or in parallel.

As in the case of the first flow channel, advantages can be achieved in the heat transfer to be obtained. Particularly through selective influencing of the throughflow direction of the first and the second flow channel, it is possible to achieve continuous countercurrent throughflow of the refrigerant and of the coolant.

In addition, it is possible, by influencing the throughflow principle, to achieve an advantageous configuration of the fluid inlets and fluid outlets of the condenser.

According to a particularly advantageous development of the invention, provision can be made for a fluid inlet or fluid outlet of the second flow channel to have a second tube, which is in fluid communication with another channel of the second flow channel.

By connecting the second flow channel to a tube as the fluid inlet or fluid outlet, it is possible to ensure that both the fluid inlet and the fluid outlet can be arranged in a common end region of the plate stack.

It is furthermore advantageous if the other channel channel is one of the last channels of the second flow channel, which lies substantially opposite the insertion side of the tube in the plate stack.

This ensures that the refrigerant or the coolant flows through the entire condenser or the flow path provided therein before it flows back again via the tube through the entire condenser and also flows out again in the same end region of the plate stack in which it flowed into the plate stack.

It is furthermore to be preferred if the second flow channel allows flow in series, and a fluid inlet and a fluid outlet of the second flow channel are each arranged in the same end region of the plate stack.

Arranging the fluid inlet and the fluid outlet in the same end region of the plate stack enables the condenser to be constructed in a particularly compact way.

In a particularly advantageous embodiment of the invention, it is furthermore envisaged that the second region of the first flow channel forms an internal heat exchanger of stacked plate design with a third flow channel, wherein a refrigerant can flow through the first flow channel and the third flow channel.

In this embodiment, the subcooling section of the second region is replaced by an internal heat exchanger. Here, the subcooling of the refrigerant is not accomplished by heat transfer between the refrigerant and the coolant.

By means of an internal heat exchanger, it is possible to intensify the cooling of the refrigerant in the condenser even further, leading to a higher capacity of the condenser overall. In an internal heat exchanger, refrigerant flows in two different flow channels, generally in a countercurrent with respect to one another.

In this case, the refrigerant flowing in the two flow channels during this process is fed to the internal heat exchanger from different sections of the refrigerant circuit, thereby achieving as large as possible a temperature difference between the two flow channels.

It is furthermore expedient if the first flow channel has a third region, which follows the second region and is used to subcool the refrigerant, wherein the third region has a third flow channel for a fluid, wherein the first and the third flow channel can be configured at least partially as heat exchangers, preferably as internal heat exchangers of stacked plate design.

The arrangement of an internal heat exchanger after the second region, in which the subcooling takes place, lowers a temperature of the refrigerant even further. There is more intense subcooling of the refrigerant than solely through the use of a subcooling section or of an internal heat exchanger.

In this case, the condenser is constructed in such a way that the heat transfer takes place between the refrigerant and the coolant in the first region, in which the refrigerant is desuperheated and condensed. In the second region, in which the refrigerant is subcooled after flowing through the receiver, heat transfer likewise takes place between the refrigerant and the coolant. In the third region, the heat transfer then takes place between the refrigerant in a first temperature range and the refrigerant in a second temperature range.

In this case, the second flow channel of the coolant is passed through the condenser in such a way that the coolant flows only through the first region and the second region and is then passed out of the condenser.

The third region of the plate stack has a fluid inlet and a fluid outlet, via which the third flow channel can be supplied with the refrigerant.

According to another preferred illustrative embodiment, provision can be made for the third flow channel to be supplied with a refrigerant independently of the first flow channel or with a coolant independently of the second flow channel.

The independent supply of the third flow channel either with a coolant or a refrigerant is particularly advantageous since, in this way, a higher temperature difference can be achieved between the third flow channel and the first flow channel. Particularly if the third flow channel is supplied with an additionally cooled fluid.

It is furthermore preferable if the receiver is in fluid communication only with the first region of the first flow channel via a tube which leads through part of the plate stack and forms the fluid inlet into the receiver, and the fluid outlet of the receiver is formed by another tube, which leads through part of the plate stack and is in fluid communication only with the second region of the first flow channel.

By means of this connection of the receiver to the first and the second region of the first flow channel by means of tubes, the receiver can be positioned outside the plate stack and, at the same time, the simple construction of the plate stack can be achieved by using a large number of identical plate elements.

In this case, the tubes are passed through the plate elements of the regions of the plate stack with which they are not supposed to be in fluid communication, and they then open into the channels of the plate stack with which they are in fluid communication. In this way, the receiver can be supplied effectively with the refrigerant from the region of the first flow channel in which the refrigerant has already fully condensed.

After flowing through the receiver, the refrigerant can furthermore be fed back to the region of the first flow channel which follows the first region. In this case, the tubes are dimensioned in such a way that the refrigerant is discharged into the receiver from one of the channels of the first flow channel and is then passed back into the following channel of the first flow channel. Here, the two channels of the first flow channel are in fluid communication with one another only via the receiver.

For this purpose, the openings of the plate element of the channel from which the refrigerant is diverted are closed in such a way that no fluid transfer can take place directly into the following channel.

Another preferred illustrative embodiment of the invention envisages that the fluid inlet, and/or the fluid outlet of the internal heat exchanger is formed by a tube.

The connection of the internal heat exchanger by means of one or two tubes is advantageous because it is possible in this way to retain the simple structure of the plate stack of the condenser. The refrigerant which flows through the third channel of the internal heat exchanger can be passed in a controlled manner into a channel of the third flow channel and also in a controlled manner out of a channel of the third flow channel by means of a tube.

It is furthermore preferable if the plates have openings with or without a rim in order to produce or seal off a fluid connection between adjacent channels.

If plate elements which are directly adjacent to one another have mutually opposite openings with rims, the fluid flows directly into the next channel but one of the plate stack. This ensures that there is alternation between channels which belong to the first flow channel and channels which belong to the second flow channel in the plate stack. In this case, uniform distribution can be produced, with a channel of the first flow channel always following a channel of the second flow channel. It is also possible to produce different distributions from this by means of said method.

It is furthermore advantageous if the tubes are passed through openings in the plate elements and are brazed to at least a subset of the plate elements, in particular to the rims.

By inserting the tubes into the openings and brazing the tubes to the plate elements and, in particular, to the rims, a compact constructional unit distinguished by high strength is achieved. Here, the tubes can advantageously be brazed to the plate stack in a single working step.

This is particularly advantageous as regards an optimized production process.

It is furthermore preferable if the first connection element is a tube and the second connection element is a flange or vice versa.

By designing the first and second connection element as described above, advantageous connection of the receiver to the condenser can be achieved. By means of a flange, it is possible, in particular, to achieve a very stable joint here, while the tube can be used for controlled feeding of the fluid into the condenser.

According to another alternative embodiment, provision can be made for the receiver to be designed to filter and/or dry the refrigerant.

In addition to the task of storage, it is also advantageous it the receiver performs the function of drying the refrigerant by suitable means for drying, and furthermore of filtering the refrigerant. In this way, it is a simple matter to remove excess moisture from the refrigerant and furthermore to free it from impurities. Integrating these functions in a single component is advantageous, particularly as regards the number of different components and the usage of installation space.

It is particularly advantageous if the first section in the second channel has a plurality of flow paths through which the fluid flows in succession and in which the flow direction is in each case alternately reversed.

It is also advantageous if the second section in the second channel has a plurality of flow paths through which the fluid flows in succession and in which the flow direction is in each case alternately reversed.

Advantageous developments of the present invention are described in the dependent claims and in the following description of the figures.

BRIEF DESCRIPTION OF THE DRAWINGS

The invention is explained in detail below by means of illustrative embodiments with reference to the drawings. In the drawings.

PREFERRED EMBODIMENT OF THE INVENTION

Figure 1:
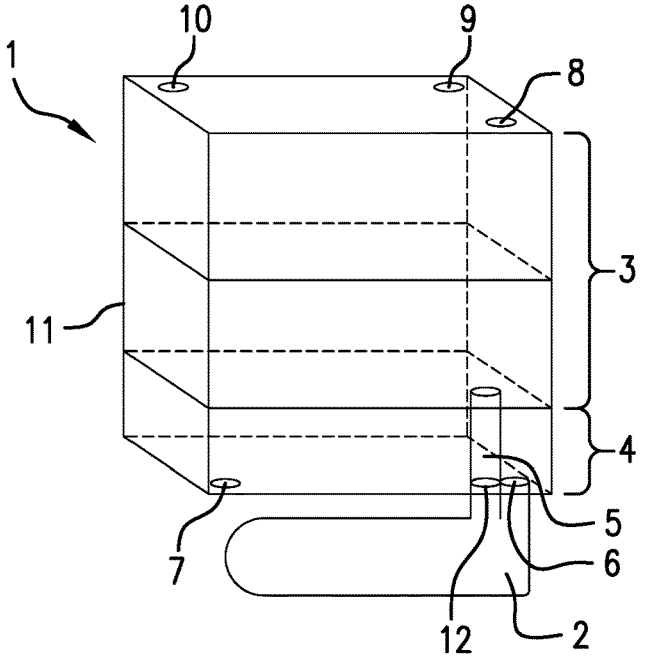
FIG. 1 shows a schematic view of a condenser, which has a region for desuperheating the refrigerant and a region for subcooling the refrigerant, wherein a receiver is arranged underneath the condenser.

Different embodiments of a condenser 1, 60, 70 of stacked plate design are shown in the following FIGS. 1 to 7. These are condensers 1, 60, 70 for use in an air-conditioning system for motor vehicles. All the condensers 1, 60, 70 shown are formed by a multiplicity of plate elements, which form a plate stack 11, 68, 87 when stacked on top of each other.

The essential advantage of construction as a condenser 1, 60, 70 of stacked plate design is that the plate elements are largely identical and only the outer connection plates and individual deflection or blocking plates installed in the stack, which deflect or block the internal flow channels, differ from the fundamentally identical shape of the plate elements. This allows low-cost and simple production.

In FIGS. 1 to 7, the condensers 1, 60, 70 are indicated only by a schematic diagram. The individual subregions of the condensers 1, 60, 70, such as the desuperheating region 3, 80 or the subcooling region 4, 81 and the region of an internal heat exchanger 61, 82, are represented in the figures only as cuboidal elements.

In reality, each of these cuboidal elements consists of a multiplicity of plate elements. These plate elements are stacked on top of each other and, through a special arrangement of openings, which can have rims, form a multiplicity of individual channels, which, by virtue of the configuration of the individual plate elements, are combined into flow channels which carry either a coolant or a refrigerant.

In this case, the flow channels of the coolant and the flow channels of the refrigerant are in all cases arranged adjacent to one another. In simple embodiments, it may be that channels for the refrigerant and channels for the coolant are arranged in a uniformly distributed alternating sequence. It is likewise conceivable to select a distribution of refrigerant channels to coolant channels which differs from uniform distribution. It is possible to provide for implementation of the frequency of alternation between coolant and refrigerant channels to differ from a ratio of 1:1.

The flow channels of the coolant and of the refrigerant are likewise indicated only schematically in FIGS. 1 to 7. In the figures, each of the cuboidal elements is traversed only once by a refrigerant and a coolant flow channel. This illustration is intended to clarify only the principle of flow through the individual condensers 1, 60, 70 and has no restrictive effect.

The flow channels of the refrigerant 25, 64, 73, 79 are each indicated by a dotted line. The flow channels of the coolant 26, 42, 52, 67, 76 are each indicated by a solid continuous line.

The flow directions of the refrigerant and of the coolant which are shown in FIGS. 1 to 7 each represent only an example and, in reality, can equally well be implemented opposite to the directions shown in FIGS. 1 to 7.

FIG. 1 shows a condenser 1 which consists of a desuperheating region 3 and a subcooling region 4. The desuperheating region 3 is used to desuperheat a refrigerant and to condense the refrigerant from its vapor phase to a liquid phase. For the purpose of desuperheating, the refrigerant is made to undergo heat exchange with a coolant, which likewise flows through the desuperheating region 3. A subcooling region 4 is connected to the desuperheating region 3 at the bottom. In this subcooling region 4, the fully liquid refrigerant is cooled down further by a further heat exchange with a coolant.

Arranged underneath the condenser 1 is a receiver 2, through which the refrigerant flows. The function of the receiver 2 is to store, filter and dry the refrigerant. Introducing a receiver 2 into the refrigerant circuit makes it possible to ensure a constant quantity of refrigerant in the refrigerant circuit at all times since the receiver 2 represents a compensating reservoir, thereby making it possible to compensate fluctuations in the volume of refrigerant in the refrigerant circuit.

At its fluid inlet 12, the receiver 2 has a tube 5, which is passed through the subcooling region 4 and is in fluid communication with the flow channel of the refrigerant in the desuperheatinq region 3. The fluid outlet 6 of the receiver 2 is, in turn, in fluid connection with the flow channel of the refrigerant in the subcooling region 4. This ensures that all the refrigerant is passed out of the desuperheating region 3 into the receiver 2.

After flowing through the receiver 2, all the refrigerant is passed back into the subcooling region 4. The receiver 2 thus represents the point of fluid transfer from the desuperheating region 3 to the subcooling region 4, especially for the refrigerant.

Openings 8, 9, 10 are arranged in the upper end region of the plate stack 11 of the condenser 1. Depending on the configuration of the internal flow channels, said openings can form fluid inlets and fluid outlets. An opening 7 is likewise shown at the lower end of the plate stack 11, and this can likewise a fluid inlet or a fluid outlet, depending on the configuration of the internal flow channels.

Figure 2:
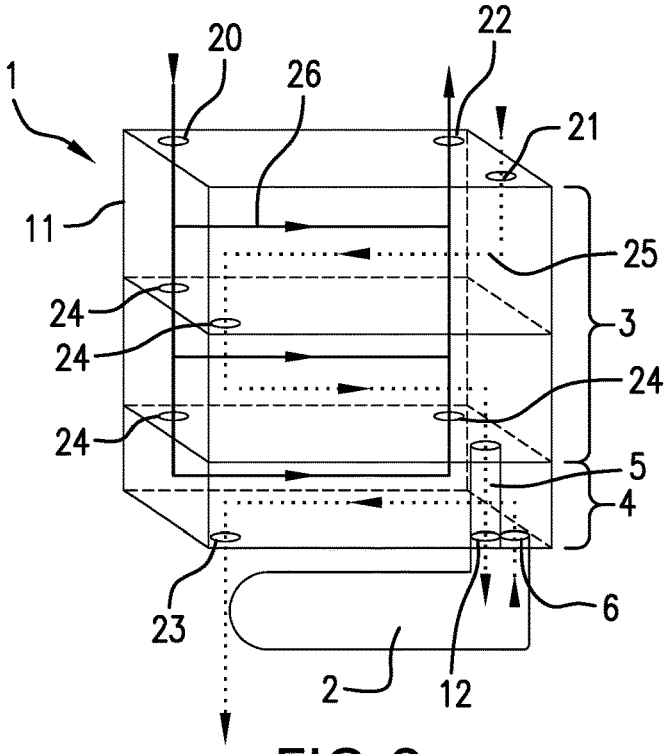
FIG. 2 shows a schematic view of a condenser in accordance with FIG. 1, illustrating two flow channels, wherein the refrigerant flows through the condenser in series and the coolant flows through the condenser in parallel.

FIG. 2 likewise shows a condenser 1, which substantially corresponds to the condenser 1 shown in FIG. 1. By way of addition to FIG. 1, flow channels 25, 26 for a coolant and a refrigerant are now shown in FIG. 2. The refrigerant flows through a fluid inlet 21 arranged in the upper end region of the plate stack 11 and into the desuperheating region 3 of the condenser 1. There, it flows through the channels formed by the plate elements, said channels belonging to the flow channel 25 of the refrigerant.

During this process, it flows, inter alia, through openings 24 arranged between the individual plate elements. After flowing through the desuperheating region 3, the refrigerant flows via the tube 5 into the receiver 2. There, it flows through the receiver 2 for the purpose of storage, filtration and drying, and then flows via the fluid outlet 6 of the receiver 2 into the subcooling region 4 of the condenser 1. After flowing through the subcooling region 4, the refrigerant flows out of the subcoolinq region 4 through the fluid outlet 23.

The coolant into the desuperheating region 3 through the fluid inlet 20 in the upper end region of the condenser 1. In contrast to the refrigerant, which flows through the individual channels in series, the coolant flows through the individual channels of the desuperheating region 3 and of the subcooling region 4 in parallel. For this purpose, the coolant is passed from the top down through the plate stack 11, through internal openings 24, which lie on an approximately rectilinear imaginary extension of the fluid inlet 20 of the coolant, and is then distributed over the width of the condenser 1. After the coolant has flowed over the entire width of the condenser 1, it then flows from the bottom up through a plurality of openings 24 in the plate elements, through the fluid outlet 22 of the coolant and out of the condenser 1.

Embodiment of the flow channel 26 of the coolant with parallel throughflow and the flow channel 25 of the refrigerant with serial throughflow leads to the formation in the condenser 1 of regions in which the refrigerant flows in a countercurrent with respect to the coolant but also regions in which the coolant flows in a co-current with respect to the refrigerant.

Figure 3:
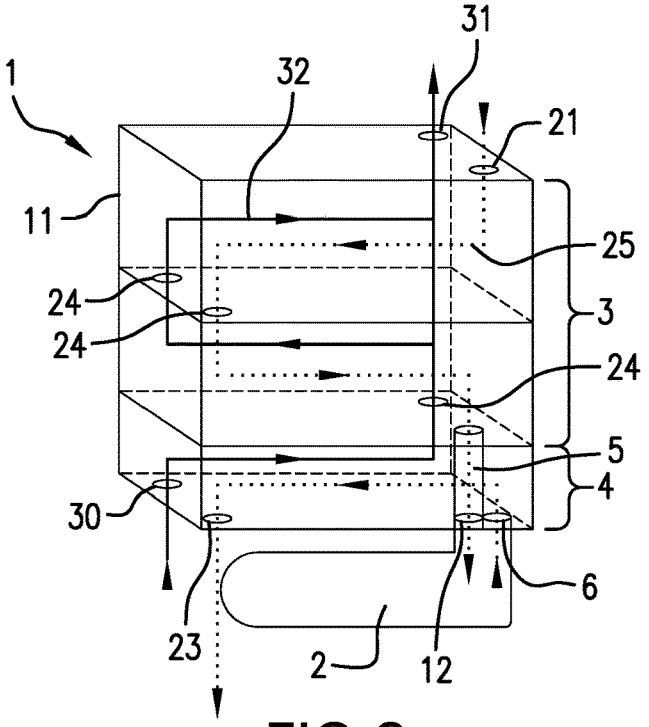
FIG. 3 shows a schematic view of a condenser in accordance with FIGS. 1 and 2, illustrating two flow channels, wherein the refrigerant flows through the condenser in series and the coolant flows through the condenser in series.
Figure 4:
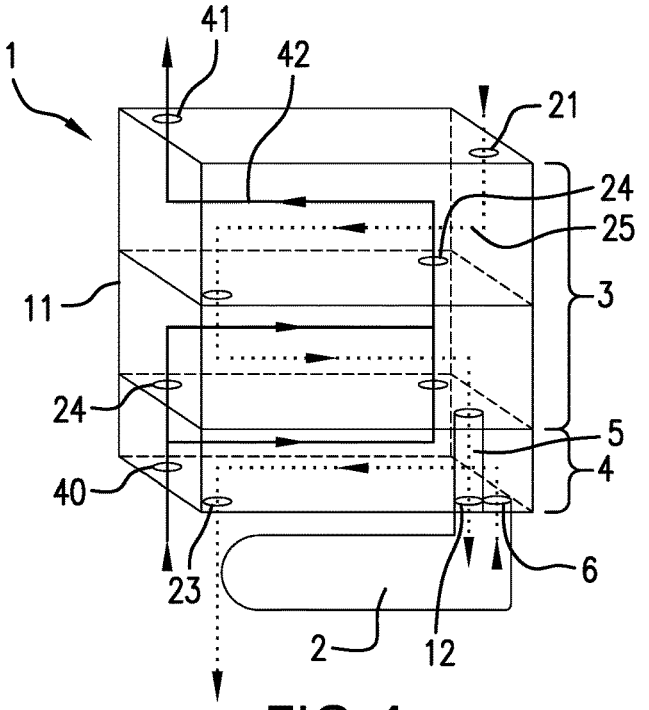
FIG. 4 shows a schematic view of a condenser in accordance with FIGS. 1 to 3, illustrating two flow channels, wherein the refrigerant flows through the condenser in series and the coolant flows through the condenser both in series and in parallel.

FIG. 3 shows a construction similar to that already illustrated in FIGS. 1 and 2. The flow channel 25 of the refrigerant is arranged through the condenser 1 of FIG. 3 in a manner similar to FIG. 1. As a departure from FIG. 2, the coolant in FIG. 3 now no longer flows through the channels of the condenser 1 in a parallel arrangement but, like the refrigerant, flows through the condenser 1 in series.

For this purpose, the coolant flows through the fluid inlet 30 in the lower region of the condenser 1 into the subcooling region 4. There, it is distributed over the width of the condenser 1 and flows upward via an internal opening into the desuperheating region 3. There, it is likewise distributed over the entire width of the condenser 1 and flows upward through a further internal opening 24 into the upper region of the desuperheating region 3 and, finally, after renewed distribution over the width of the condenser 1 flows out of the condenser 1 through the fluid outlet 31. Thus, in FIG. 3, the flow channel 32 of the coolant, like the flow channel 25 of the refrigerant, passes in series through the individual channels in the interior of the condenser 1. In the illustration shown in FIG. 3, the refrigerant stream is in a countercurrent configuration with respect to the coolant throughout the condenser 1.

FIG. 4 again shows a condenser 1 similar to FIGS. 1 to 3. The refrigerant flow channel 25 is embodied in a manner similar to FIGS. 2 and 3. As a departure from FIGS. 2 and 3, the flow channel 42 of the coolant is now arranged in such a way within the condenser 1 that there are both regions in which flow through the condenser takes place in parallel and regions in which it takes place in series.

For this purpose, the coolant flows through the fluid inlet 40 into the subcooling region 4 of the condenser 1. There, it is distributed both over the width of the condenser 1 and upward through an internal opening 24 into the desuperheating region 3. In the desuperheating region 3, the coolant is likewise distributed over the entire width of the condenser 1. The coolant stream in the subcooling region 4 likewise flows upward via an internal opening 24 into the desuperheating region 3, where the coolant stream from the subcooling region 4 and that from the desuperheating region 3 reunite. Together, the coolant there flows via a further internal opening 24 into the upper region of the desuperheating region 3 and is again distributed there over the entire width of the condenser 1 and, finally, flows via the fluid outlet 41 of the coolant out of the condenser 1.

In this way, some of the coolant flows through the condenser 1 in parallel and some of it flows through the condenser 1 in series. There are thus regions in which the coolant flows in countercurrent with respect to the refrigerant and regions in which the coolant flows in co-current with respect to the refrigerant.

Figure 5:
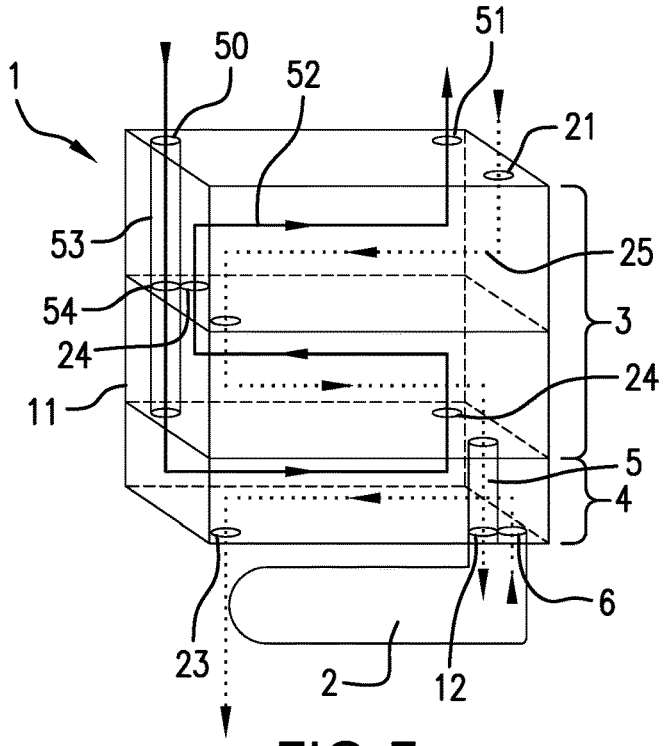
FIG. 5 shows a schematic view of a condenser in accordance with FIGS. 1 to 4, illustrating two flow channels, wherein the refrigerant flows through the condenser in series and the coolant flows through the condenser in series, wherein the coolant is passed through the condenser by means of a tube.

FIG. 5 likewise shows a condenser 1 similar to the embodiments of FIGS. 1 to 4. Once again, the embodiment of the flow channel 25 of the refrigerant is unchanged relative to FIGS. 2 to 4. As a departure from the previous figures, the coolant is now passed through the condenser 1 only in series and is fed in and discharged at the condenser through a fluid inlet 50 and a fluid outlet 51, arranged in one of the end regions of said condenser.

However, the coolant is not distributed over the width of the condenser 1, as in the previous figures, but is carried downward into the subcooling region 4 of the condenser 1 through openings 54 in the plate elements by a tube 53 connected to the fluid inlet 50. Only in the subcooling region 4 does the coolant leave the tube 53 and distribute itself over the width of the condenser 1.

On the opposite side of the condenser 1, the coolant flows upward again through an internal opening 24 into the desuperheating region 3, where it is again distributed over the width of the condenser 1. It then flows through a further opening 24 into the upper region of the desuperheating section and, there too, is distributed over the width of the condenser 1, before it flows out of the condenser 1 via the fluid outlet 51 of the coolant.

The coolant thus flows in series through all the regions of the condenser 1. The coolant which flows in flow channel 52 thus flows in countercurrent with respect to the refrigerant in flow channel 25 at all times.

Figure 6:
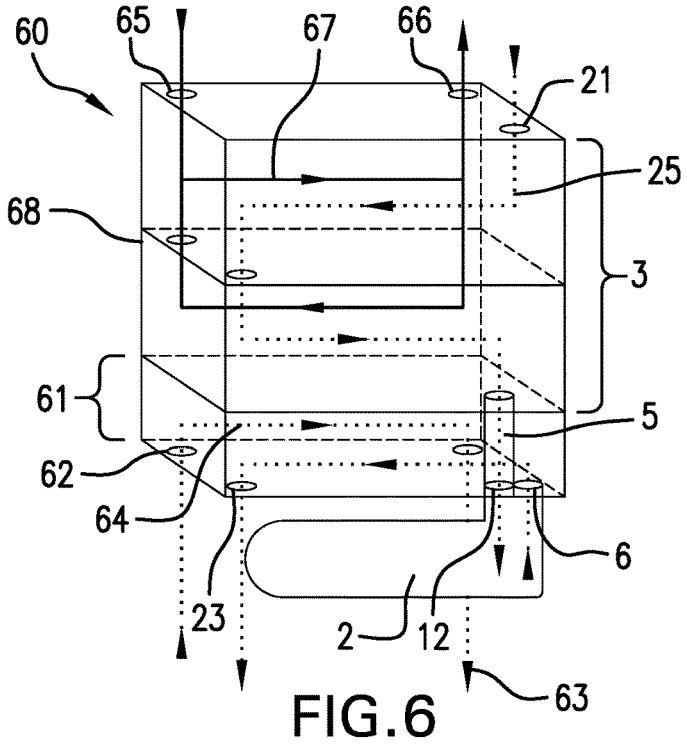
FIG. 6 shows a schematic view of a condenser in accordance with FIGS. 1 and 2, wherein the region for cooling the refrigerant is formed by an internal heat exchanger, illustrating two flow channels, wherein the refrigerant flows through the condenser in series and the coolant flows through the condenser in parallel.

FIG. 6 shows a condenser 60, which, as a departure from the condensers 1 in FIGS. 1 to 5, now has a desuperheating region 3 in the upper region and, arranged below the latter, an internal heat exchanger 61, which replaces the subcooling region 4 of FIGS. 2 to 5. The flow channel 25 of the refrigerant is passed through the condenser 60 in a manner similar to FIGS. 2 to 5.

The coolant flows into the condenser 60 through a fluid inlet 65 on the upper side of the plate stack 68 of the condenser 60. There, it is distributed at a low level over the desuperheating region 3 through an internal opening 24 and is then distributed over the width of the condenser 60 before it flows upward out of the condenser 60 again through openings 24 and the fluid outlet 66.

In FIG. 6, the coolant flows in parallel through the desuperheating region 3. The refrigerant furthermore flows in series through the desuperheating region 3, through the flow channel 25 of the refrigerant, thereby establishing regions of co-current flow and regions of countercurrent flow between the refrigerant and the coolant.

The coolant does not flow through the region 61 which forms the internal heat exchanger. Instead, the internal heat exchanger 61 has a third flow channel 64, through which the refrigerant likewise flows. For this purpose, the refrigerant flows through a fluid inlet 62 into the internal heat exchanger 61 and is distributed there over the width of the condenser 60, before it flows out of the condenser 60 via the fluid outlet 63. In the internal heat exchanger 61, the refrigerant in flow channel 64 and the refrigerant in flow channel 25 are in countercurrent with respect to one another. In this way, a higher heat transfer can be achieved between the two flow channels 64, 25.

The refrigerant which flows through flow channel 64 of the internal heat exchanger 61 comes from the same refrigerant circuit as the refrigerant in flow channel 25. The refrigerant in flow channel 64 differs from the refrigerant in flow channel 25 essentially in the temperature thereof. Since the aim is to further cool the refrigerant in flow channel 25 within the internal heat exchanger 61, the refrigerant in flow channel 64 has a lower temperature, thereby enabling further heat to be withdrawn from the refrigerant in flow channel 25.

The embodiment shown in FIG. 6 represents an alternative to the embodiments of a condenser 1 shown in FIGS. 1 to 5, which have a subcooling region 3. Instead of the subcooling by a heat transfer between a coolant and the refrigerant, a heat transfer is here produced between the refrigerant at a first temperature level and the refrigerant at a second temperature level.

Figure 7:
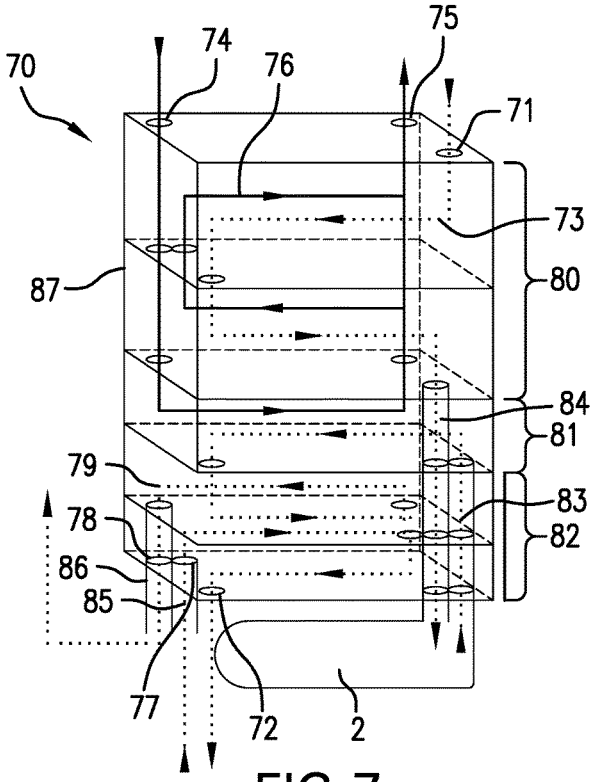
FIG. 7 shows a schematic view of a condenser, wherein the desuperheating region is followed by a subcoolinq region, to which an internal heat exchanger is connected.

FIG. 7 then shows a condenser 70 which consists of a plate stack 87. In this case, the condenser 70 is a combination of the illustrative embodiments in FIGS. 1 to 6. A subcooling region 81 adjoins the upper desuperheating region 80 at the bottom. An internal heat exchanger 82 is connected to the bottom of the subcooling region 81.

A coolant flows through the upper region of the condenser 70, which consists of the desuperheating region 80 and the subcooling region 81, in a manner corresponding to the throughflow already shown for the coolant in FIG. 2. For this purpose, a coolant flows through the fluid inlet 74 into the desuperheating region 80 and is distributed there via internal openings along the depth of the condenser 70, as far as the subcooling region 81. It then flows uniformly through the condenser 70 across the width thereof, before it flows upward through internal openings at the opposite end and out of the condenser 70 via the fluid outlet 75. The coolant flows through the condenser 70 fully in parallel in the flow channel 76 thereof.

The refrigerant flows into the desuperheating region 80 through a fluid inlet 71 and flows through the desuperheating region 80 in series. The refrigerant then flows directly from the desuperheating region 80, via a tube 84 leading through the subcooling region 81 and the internal heat exchanger 82, into the receiver 2. From the receiver 2, the refrigerant flows back via tube 83 into the subcooling region 81 and is distributed there over the width of the condenser 70. It then flows through an internal opening from the subcooling region 81 into the internal heat exchanger 82, situated under said region, and flows through the individual channels of the internal heat exchanger 82, likewise in series, before it flows out of the internal heat exchanger 82 via the fluid outlet 72 and out of the condenser 70.

A refrigerant furthermore flows through the internal heat exchanger 82. For this purpose, a refrigerant flows via a fluid inlet 77, which can be designed as a tube 85, into the internal heat exchanger 82. There, it is distributed over the width of the internal heat exchanger 82 and flows through an internal opening into the upper region of the internal heat exchanger 82. There, it is likewise again distributed over the width of the condenser 70 and, finally, flows via a tube 86, which leads through the lower region of the internal heat exchanger 82, out of the condenser 70. Tube 86 thus also forms the fluid outlet 78 of the flow channel 79 of the refrigerant.

The positions of the fluid inlets and fluid outlets shown in FIGS. 1 to 7 are in each case illustrative. Orientations that differ therefrom, e.g. laterally on the condenser, can be provided, as can the arrangement of a fluid inlet or outlet in a central region of the condensers. Indeed, FIGS. 1 to 7 are intended to show illustrative embodiments which make clear that it is possible to pass a refrigerant stream and a coolant stream through the individual regions of the condensers 1, 60, 70 both by the co-current principal and by the counter-current principle. Different advantages for the arrangement of the fluid inlets and fluid outlets are thereby obtained. Appropriate internal configuration of the plate stack 11, 68, 87 of the condensers 1, 60, 70 is to be implemented, depending on the envisaged area of application of the condensers 1, 60, 70.

The condensers 1, 60, 70 can furthermore be produced selectively from a combination of a desuperheating region 3, 80, a subcoolinq region 4, 81 and an internal heat exchanger 61, 32. Here, optimum configurations which all have a simple construction consisting of individual plate elements and are thus very flexible in construction can be produced, depending on the intended use.

The tubes shown in FIGS. 1 to 7 can likewise be produced at low cost and, in the simplest case, are inserted into the plate stacks 11, 68, 87, passing through internal openings in the plate elements. It is advantageous if this takes place at an early stage of the production process, allowing the plate elements to be brazed to the individual tubes in one operation. In particular, the tubes are brazed to the openings, which have rims.

Figure 8:
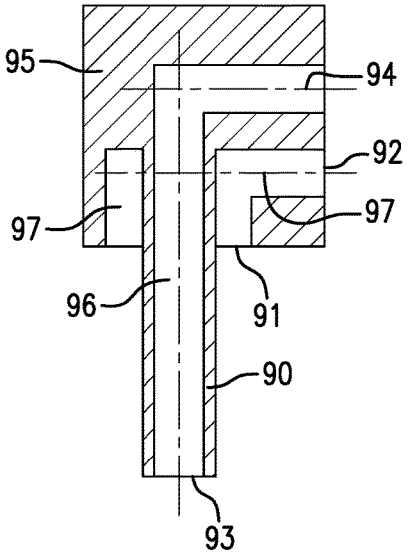
FIG. 8 shows a section through a connection point at which a tube opens into one of the channels within the condenser.

FIG. 8 shows a section through a connection element, by means of which the receiver 2, for example, can be connected to the respective lower regions of the condensers 1, 60 in FIGS. 1 to 6. For this purpose, the connection element has a tube 90, which forms a flow channel 96 between a fluid inlet 93 and a fluid outlet 94. In FIGS. 1 to 6, this tube 90 corresponds to tube 5, which connects the receiver 2 to the lower part of the desuperheating region 3. At the same time, the receiver 2 is in fluid communication with the subcooling region 4 or the internal heat exchanger 61 via flow channel 97, which is formed between the fluid inlet 91 and the fluid outlet 92.

The principal function of the connection element shown in FIG. 8 is to carry the refrigerant out of different channels within the condensers 1, 60 and out of the desuperheating region 3 and then to feed it back to the subcooling region 4 or to the internal heat exchanger 61, which is arranged underneath the desuperheating region 3.

As already described, tube 90 passes through at least one of the plate elements of the condensers 1, 60. In FIG. 8, the condenser is denoted by the reference sign 95. It can be seen, in particular, that flow channel 97 extends completely around tube 90.

Figure 9:
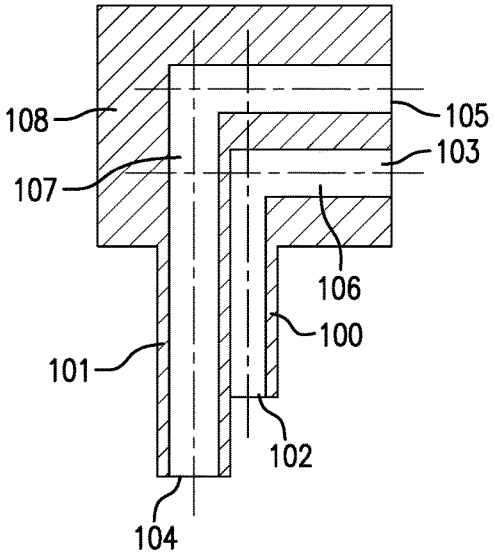
FIG. 9 shows a section through a point of connection at which two tubes open in two mutually adjacent channels of the condenser.

FIG. 9 shows another alternative connection element, which can be used, in particular, in an arrangement corresponding to FIG. 7. In this case, a first tube 100 is arranged parallel to a second tube 101. Tube 100 forms a flow channel 106 which extends between a fluid inlet 102 and a fluid outlet 103. Tube 101 forms as it were a flow channel 107 which extends between a fluid inlet 104 and a fluid outlet 105. In FIG. 9, the condenser is identified by the reference sign 108.

The principal function of the connection element in FIG. 9 is to discharge a fluid from a region of the condenser 1, 60, 70, 108 and to feed it to the receiver 2. This takes place via the longer tube 101. The fluid is carried back from the receiver 2 to the condenser 1, 60, 70, 108 via the shorter tube 100. By means of the length of the tubes 100, 101 and resulting differences in the heights of the fluid outlets 103, 105, it is possible to discharge the fluid from the condenser 1, 60, 70, 108 and feed it back to the latter at different levels relative to the condenser 1, 60, 70, 108.

The fluid inlets and fluid outlets shown in FIGS. 8 and 9 can also each be arranged in reverse, depending on the flow direction.

The invention claimed is:

1. A condenser of stacked plate design comprising a first flow channel for a refrigerant;

a second flow channel for a coolant;

a plurality of plate elements forming channels adjacent to each other between the plate elements when the plate elements are stacked on top of each other, wherein the first flow channel comprises a first subset of the channels, wherein the second flow channel comprises a second subset of the channels, wherein the plurality of plate elements are divided into a first region for desuperheating and condensing the vaporous refrigerant and a second region for subcooling the condensed refrigerant, wherein the first flow channel and the second flow channel flow through the first region and the second region;

a receiver for storing the refrigerant, wherein the refrigerant transfer from the first region to the second region leads through the receiver, wherein the receiver is in fluid communication with the first region using a first connection element forming a fluid inlet of the receiver, wherein the first connection element comprises a tube extending from the receiver and passing through openings in the plate elements of the second region, wherein the tube opens up into a plate element of the first region on one side and the receiver on the other side, wherein a second connection element is in fluid communication with the second region as a fluid outlet of the receiver, wherein the second region forms an internal heat exchanger of stacked plate design having a third flow channel fluidically separate within condenser from the first flow channel and the second flow channel, wherein the refrigerant flows through the first flow channel and the third flow channel such that the refrigerant in the third channel cools the refrigerant in the first channel.

2. The condenser as claimed in claim 1, wherein the first connection element is a channel, and the channel leads from the first region, through the second region, to the fluid inlet of the receiver, wherein the channel is in fluid communication only with the first region of the first flow channel.

3. The condenser as claimed in claim 2, wherein the channel is a tube.

4. The condenser as claimed in claim 1, wherein the second connection element is a channel, and the channel leads from the fluid outlet of the receiver, through the first region, into the second region.

5. The condenser as claimed in claim 1, wherein the fluid inlet or fluid outlet of the second flow channel has a second tube, which is in fluid communication with a channel of the second subset of the channels of the second flow channel.

6. The condenser as claimed in claim 5, wherein the channel of the second subset of flow channels of the second flow channel is one of the last channels of the second flow channel, which lies substantially opposite the insertion side of the tube in the plate stack.

7. The condenser as claimed in claim 1, wherein the second flow channel allows flow in series, and the fluid inlet and the fluid outlet of the second flow channel are each arranged in the same end region of the plate stack.

8. The condenser as claimed in claim 1, wherein the first flow channel has a third region, which follows the second region and is used to subcool the refrigerant, wherein the third region has a third flow channel for a fluid, wherein the first and the third flow channel are configured at least partially as the internal heat exchangers of stacked plate design.

9. The condenser as claimed in claim 8, wherein the third flow channel is supplied with the refrigerant independently of the first flow channel or with a coolant independently of the second flow channel.

10. The condenser as claimed in claim 1, wherein the receiver is in fluid communication only with the first region of the first flow channel via a tube which leads through part of the plate stack and forms the fluid inlet into the receiver, and the fluid outlet of the receiver is formed by another tube, which leads through part of the plate stack and is in fluid communication only with the second region of the first flow channel.

11. The condenser as claimed in claim 1, wherein the fluid inlet or the fluid outlet of the internal heat exchanger is formed by a tube.

12. The condenser as claimed in claim 1, wherein the plates have openings with or without a rim to produce or seal off a fluid connection between adjacent channels.

13. The condenser as claimed in claim 1, wherein the tubes are passed through openings in the plate elements and are brazed to at least a subset of the plate elements.

14. The condenser as claimed claim 1, wherein the first connection element is a tube and the second connection element is a flange or vice versa.

15. The condenser as claimed in claim 1, wherein the receiver is designed to filter or dry the refrigerant.

16. The condenser as claimed in claim 1, wherein second channel in the first region has a plurality of flow paths through which the fluid flows in succession and in which the flow direction is in each case alternately reversed.

17. The condenser as claimed in claim 1, wherein second channel in the second region has a plurality of flow paths through which the fluid flows in succession and in which the flow direction is in each case alternately reversed.

18. A condenser of stacked plate design comprising a first flow channel for a refrigerant;

a second flow channel for a coolant;

a plurality of plate elements forming channels adjacent to each other between the plate elements when the plate elements are stacked on top of each other, wherein the first flow channel comprises a first subset of the channels, wherein the second flow channel comprises a second subset of the channels, wherein the plurality of plate elements are divided into a first region for desuperheating and condensing the vaporous refrigerant and a second region for subcooling the condensed refrigerant, wherein the first flow channel and the second flow channel flow through the first region and the second region;

a receiver for storing the refrigerant, wherein a refrigerant transfer from the first region to the second region leads through the receiver, wherein the receiver is in fluid communication with the first region using a first connection element forming the fluid inlet of the receiver, wherein the first connection element comprises a tube extending from the receiver and passing through openings in the plate elements of the second region, wherein the tube opens up into a plate element of the first region on one side and the receiver on the other side, wherein the tube is in fluid communication only with the first region of the first flow channel and the receiver, wherein a second connection element is in fluid communication with the second region as a fluid outlet of the receiver, wherein the second region forms an internal heat exchanger of stacked plate design having a third flow channel fluidically separate within condenser from the first flow channel and the second flow channel, wherein the refrigerant flows through the first flow channel and the third flow channel such that the refrigerant in the third channel cools the refrigerant in the first channel.

* * * * *